US007144266B2

(12) United States Patent
Bhutani

(10) Patent No.: US 7,144,266 B2
(45) Date of Patent: Dec. 5, 2006

(54) ROTATABLE EARTH PIN IN AN ELECTRICAL PLUG

(75) Inventor: Gurmeet S. Bhutani, Pasig (PH)

(73) Assignee: Astec International Limited, Hong Kong (HK)

( * ) Notice: Subject to any disclaimer, the term of this patent is extended or adjusted under 35 U.S.C. 154(b) by 0 days.

(21) Appl. No.: 11/213,197

(22) Filed: Aug. 25, 2005

(65) Prior Publication Data

US 2006/0046541 A1 Mar. 2, 2006

Related U.S. Application Data

(60) Provisional application No. 60/605,727, filed on Aug. 30, 2004.

(51) Int. Cl.
*H01R 4/66* (2006.01)

(52) U.S. Cl. ..... 439/352

(58) Field of Classification Search ..... 439/104, 439/106, 131, 11, 172, 13, 956, 640, 126, 439/127

See application file for complete search history.

(56) References Cited

U.S. PATENT DOCUMENTS 3,958,849 A * 5/1976 Blairsdale ..... 439/104
5,494,449 A * 2/1996 Chioo ..... 439/76.1
6,863,558 B1 * 3/2005 Negishi et al. ..... 439/404
2003/0068909 A1 * 4/2003 Su ..... 439/131

FOREIGN PATENT DOCUMENTS

| | | |
|---|---|---|
| GB | 2 215 531 A | 9/1989 |
| GB | 2 303 256 A | 2/1997 |
| GB | 2 332 787 | 6/1999 |
| GB | 2 381 669 | 5/2003 |

OTHER PUBLICATIONS http://www.42technology.com/examples/plug.html, "Folding Electrical Plug", 1 page, Feb. 23, 2006.

* cited by examiner

*Primary Examiner*—Phuong Dinh
(74) *Attorney, Agent, or Firm*—Nixon Peabody LLP

(57) ABSTRACT

An electrical plug is disclosed having a rotatable earth pin that can be folded into a plug body by rotating the rotatable earth pin from an unfolded position to a folded position. In the unfolded position, the rotatable earth pin is interlocked with the plug body through a locking tab on a snap lock that latches onto the plug body. To release the rotatable earth pin from its unfolded position, pressure is exerted onto the locking tab to release the snap lock, which allows the rotatable earth pin to move and rotate to a folded position. Locking pins and associated grooves releasably retain the rotatable earth pin in its folded position.

15 Claims, 11 Drawing Sheets

ROTATABLE EARTH PIN IN AN ELECTRICAL PLUG

CROSS REFERENCE TO RELATED APPLICATION

This application claims the benefit of U.S. provisional application Ser. No. 60/605,727 filed Aug. 30, 2004.

FIELD OF INVENTION

The invention relates generally to electrical plugs and more particularly to electrical plugs having movable earth pins.

BACKGROUND OF THE INVENTION

A wide variety of electrical devices typically draw AC power from a commercial source, usually delivered through a wall receptacle or socket, via a corresponding electrical plug.

A conventional electrical plug typically has a pair of conductive power pins for insertion into corresponding female connectors in the socket. The plug typically also includes an earth or ground pin that is inserted into a corresponding female connector in the socket that is coupled to ground. In certain countries, the earth pin is slightly longer than the power pins and also functions to open a spring loaded shutter in the socket, to allow insertion of the power pins into their respective female connectors in the socket. This safety feature thus requires that an earth pin be included in all plugs even when there is no need for a ground connection.

Battery chargers comprise one type of electrical device whose plugs typically do not require an earth or ground connection. However, to provide the shutter opening function, a dummy ground pin still needs to be provided. Such prior art earth pins are usually in a fixed position on the electrical plug, which makes the electrical plug unnecessarily bulky.

One prior art method for repositioning the earth pin in an electrical plug is to connect the earth pin to a hinge, to enable the pin to be rotated between two positions, an open position and a stored position. The pin is rotated 90° between these two positions about the axis of the hinge.

Consumers of electrical products in recent times have shown a desire for more compact designs. Accordingly, there is a need to reduce the amount of space taken up by an electrical plug when not in use, to enable the plug to be more compact.

SUMMARY OF THE INVENTION

The present invention is an electrical plug having a rotatable earth pin that can be folded into a plug body by rotating the rotatable earth pin from an unfolded position to a folded position. In the unfolded position, the rotatable earth pin is interlocked with the plug body through a locking tab with a snap lock that latches onto the plug body. To release the rotatable earth pin from an unfolded position, a pressure is exerted onto the locking tab, which allows the rotatable earth pin to move and rotate to a folded position.

Broadly stated, the electrical plug comprises: a plug body having a first conductive blade and a second conductive blade; and a rotatable earth pin having an arm and an earth pin blade, the arm having a pair of pivot pins on the sides thereof for enabling the rotatable earth pin to rotate from an unfolded position to a folded position, and the rotatable earth pin enabled to be releasably locked in said folded position by a pair of locking pins located on the sides of said rotatable earth pin arm at a position spaced from said pivot pins.

The other structures and methods regarding to the present invention are disclosed in the detailed description below. This summary does not purport to define the invention. The invention is defined by the claims. These and other embodiments, features, aspects, and advantages of the invention will become better understood with regard to the following description, appended claims and accompanying drawings.

Reference symbols or names are used in the figures to indicate certain components, aspects or features therein, with reference symbols common to more than one figure indicating like components, aspects of features shown therein.

DETAILED DESCRIPTION OF PREFERRED EMBODIMENTS

Figure 1:
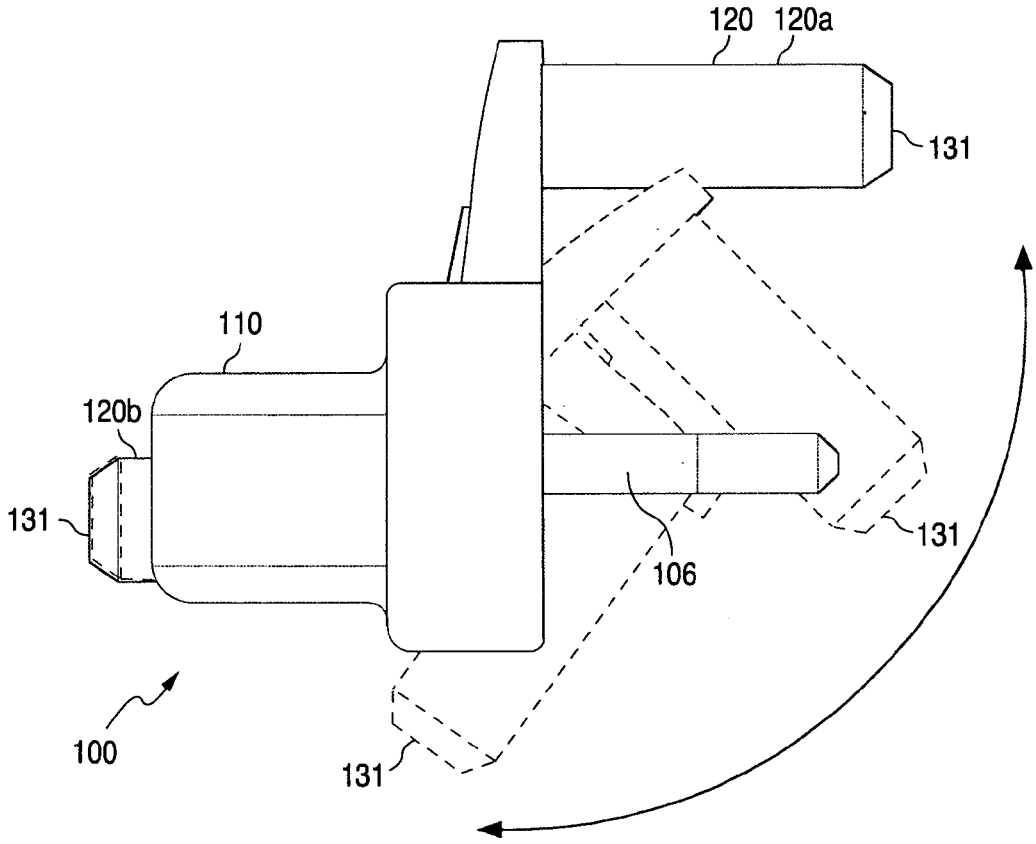
FIG. 1 is a side view of a rotatable earth pin plug having a rotatable earth pin that is shown being unfolded from a plug body in accordance with the present invention.
Figure 2:
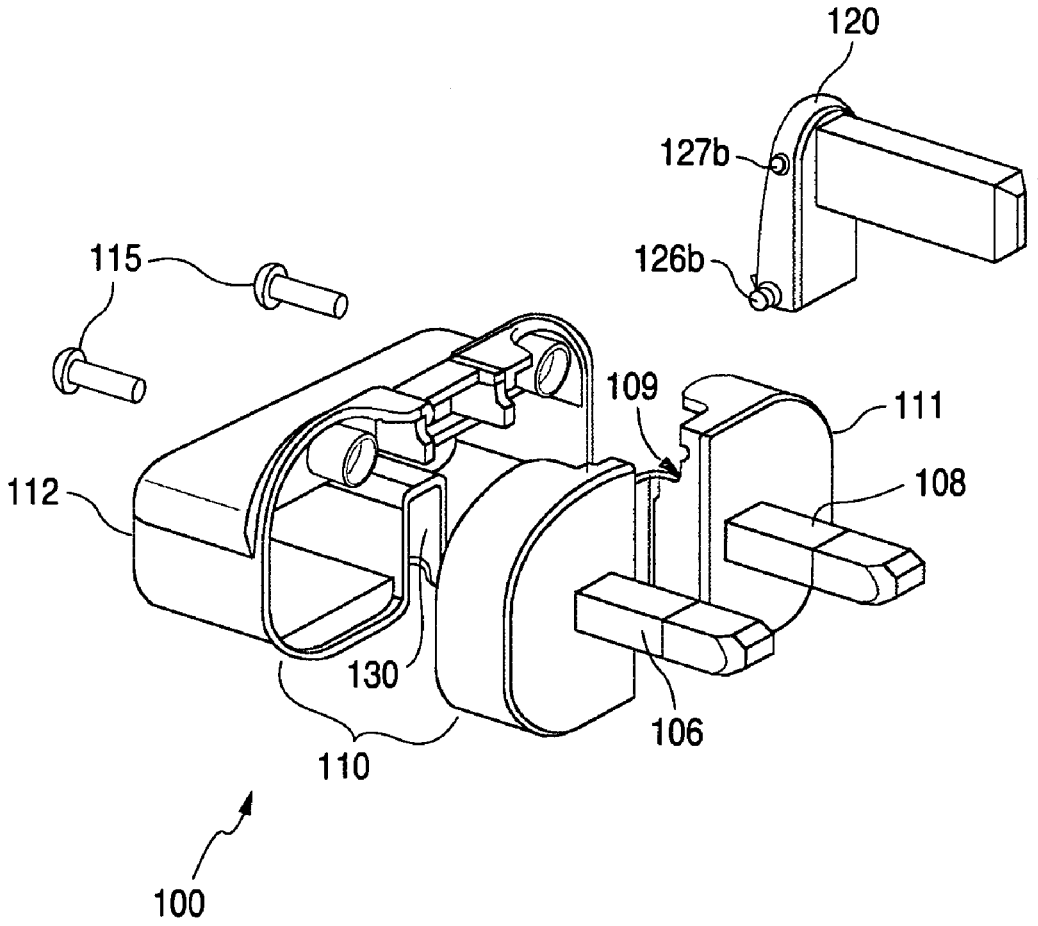
FIG. 2 is an exploded perspective view of the front and right side of the rotatable earth pin plug in accordance with the present invention.
Figure 3:
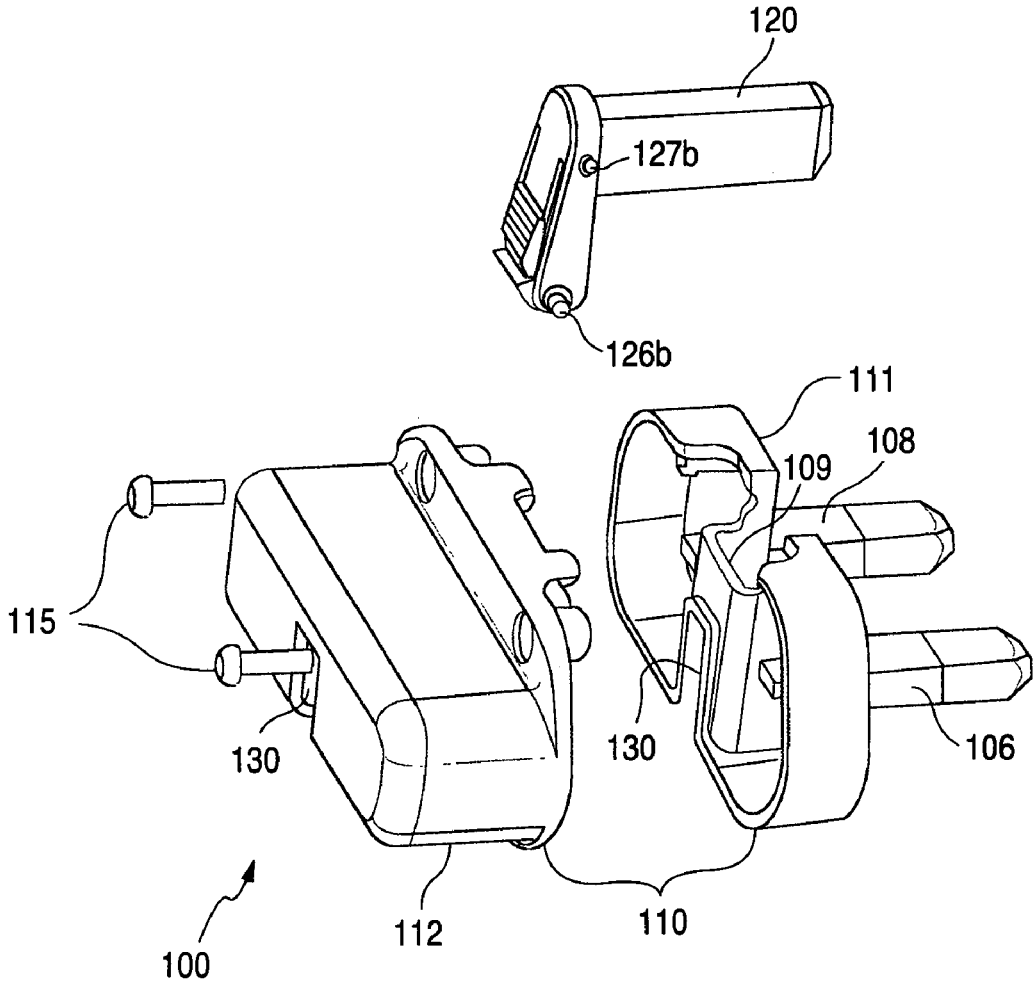
FIG. 3 is an exploded perspective view of the back and right side of the rotatable earth pin plug in accordance with the present invention.

Referring now to FIGS. 1–3, there are shown a side view and exploded perspective views of a rotatable earth pin plug 100 in accordance with the present invention. The rotatable earth pin comprises a rotatable earth pin 120 for folding into a plug body 110 having a first conductive blade 106 and a second conductive blade 108. The rotatable earth pin 120 is able to rotate preferably a full 180° so that it folds into a channel 109 and passage 130 of the plug body 110 without any protrusions in either the x-direction or y-direction of the rotatable earth pin 120. The earth pin plug is shown in its unfolded position at 120*a* and in phantom to illustrate its movement from its unfolded position to its folded position, shown at 120*b*.

Exploded views of the rotatable earth pin plug 100 are shown in FIGS. 2–3. The plug body 110 has a front piece 111 having the channel 109 and the first and second conductive blades 106 and 108 extending outwardly therefrom, a back piece 112, and a pair of screws 115 or other suitable fastener to join front piece 111 to back piece 112. Earth pin 120 includes opposite pivot pins 126*a* and 126*b* (See also FIGS. 4A–4B) that define the axis of rotation of earth pin 120 once earth pin 120 is assembled within plug body 110.

Figure 4A:
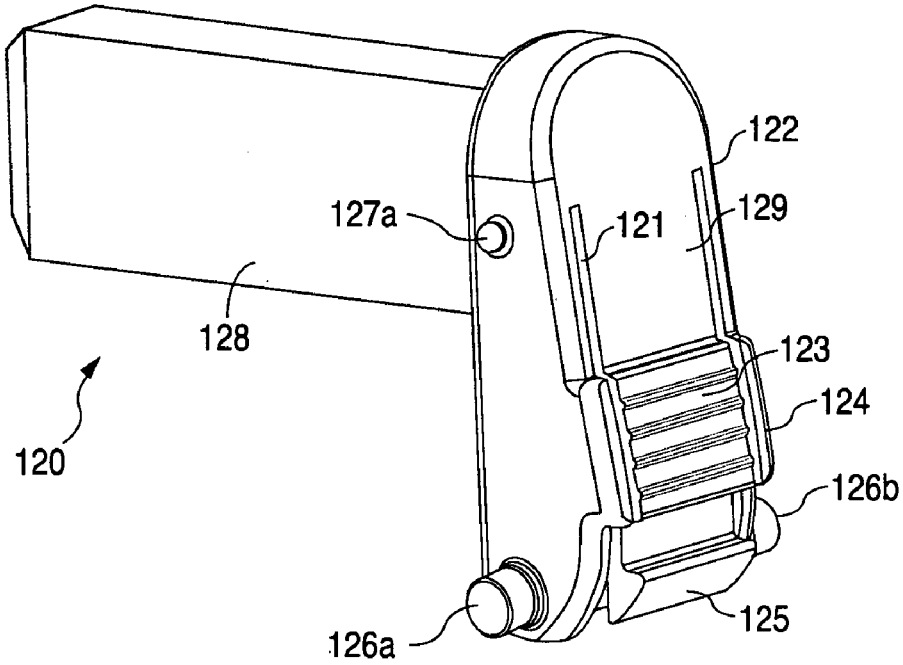
FIGS. 4A–4B are perspective views respectively illustrating the front and left side and front and right side of the rotatable earth pin with the various locking mechanisms in accordance with the present invention.
Figure 4B:
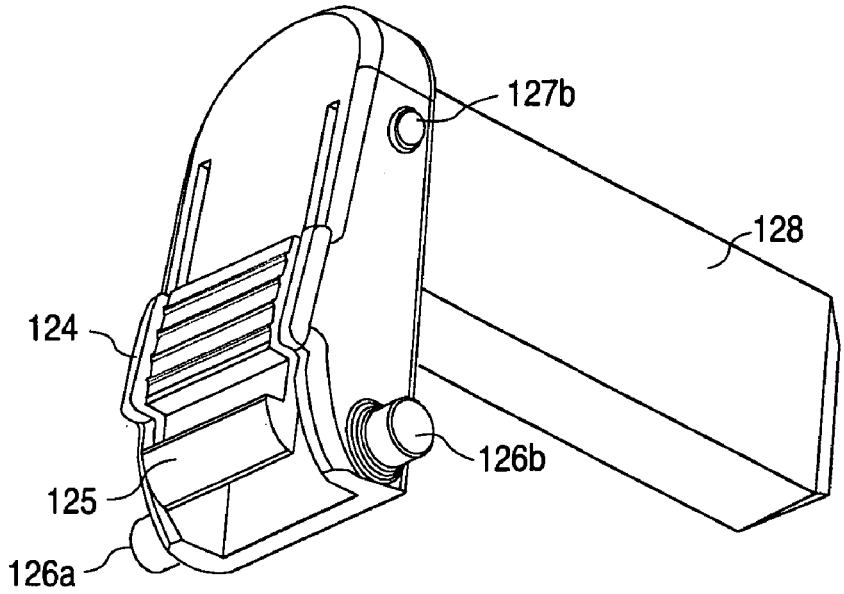

FIGS. 4A–4B are perspective views of the earth pin 120 showing the various locking mechanisms in the rotatable earth pin 100 of the present invention. The earth pin 120 is an L shape formed by an arm 122, preferably of a flexible material, and an earth pin blade 128. Earth pin 120 is preferably a dummy ground pin, to provide the shutter opening function described above. The front surface of arm 122 includes side locks 124 and a flexible appendage 129 having grooves 121, a locking press tab 123 and a snap lock 125. The sides of arm 122 include the pivot pins 126*a* and 126*b*. A folded locking pin 127*a* and a folded locking pin 127*b* are formed on respective upper sides of arm 122. The side locks 124 are used to prevent backward movement of the earth pin 120 while earth pin plug 100 is being plugged into an electrical source (not shown). The snap lock 125 snaps into the plug body 110 for fixing the rotatable earth pin 120 in its unfolded position. To unlock the rotatable earth pin 120, the locking tab 123 is pressed down toward the grooves 121 to cause the snap lock 125 to clear the plug body 110, as described below, and thereby enable manual rotation of the rotatable earth pin 120 by 180° or so to its folded position where locking pins 127*a* and 127*b* lock into the plug body 110 to fix the earth pin 120 in its folded position.

Note that, in its folded or stowed position, earth pin 120 provides an indication that an attempted insertion of plug 100 into a socket is incorrect. That is, the front surface of arm 122 protrudes out from plug body 110 in the direction of blades 106 and 108 to restrict the complete insertion of plug 100 into the socket. Consequently, even where the socket does not include a shutter opening function, earth pin 120 prevents the full insertion of plug 100 into a socket when the rotatable earth pin 120 is in its folded position.

Figure 5:
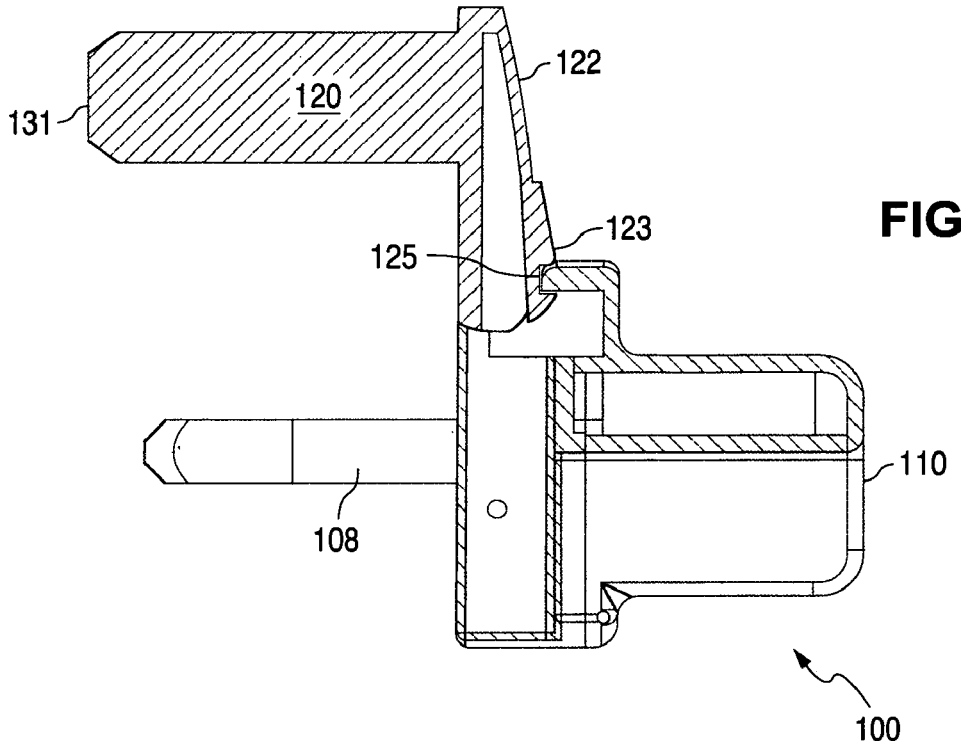
FIG. 5 is a cross-sectional left side view of the electrical plug where the rotatable earth pin is in an interlocked, unfolded position in accordance with the present invention.

Turning now to FIG. 5, there is shown an electrical plug 100 in which the rotatable earth pin 120 is in its unfolded position. The snap lock 125 of the flexible arm 122 latches onto the plug body 110 in the unfolded position. As can be seen in this figure, the side locks 124 of the flexible arm 122 also mate with the surface of the plug body 110 to prevent backward movement of earth pin while plugging into an electrical source (not shown).

Figure 6A:
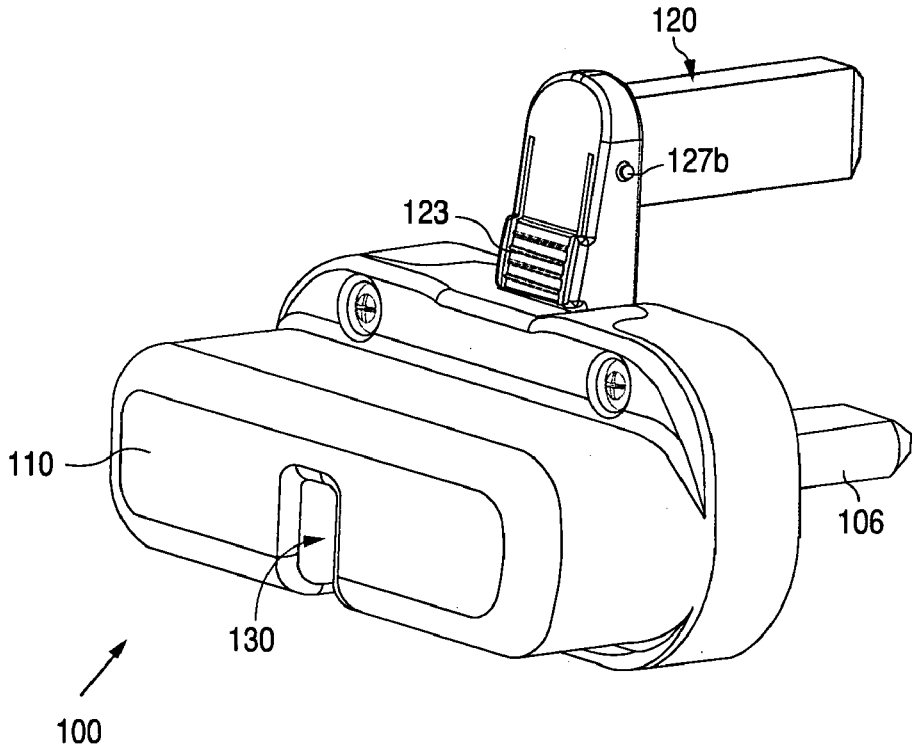
FIG. 6A is a perspective back and right side view of the rotatable earth pin plug showing the rotatable earth pin in its interlocked, unfolded position in accordance with the present invention.
Figure 6B:
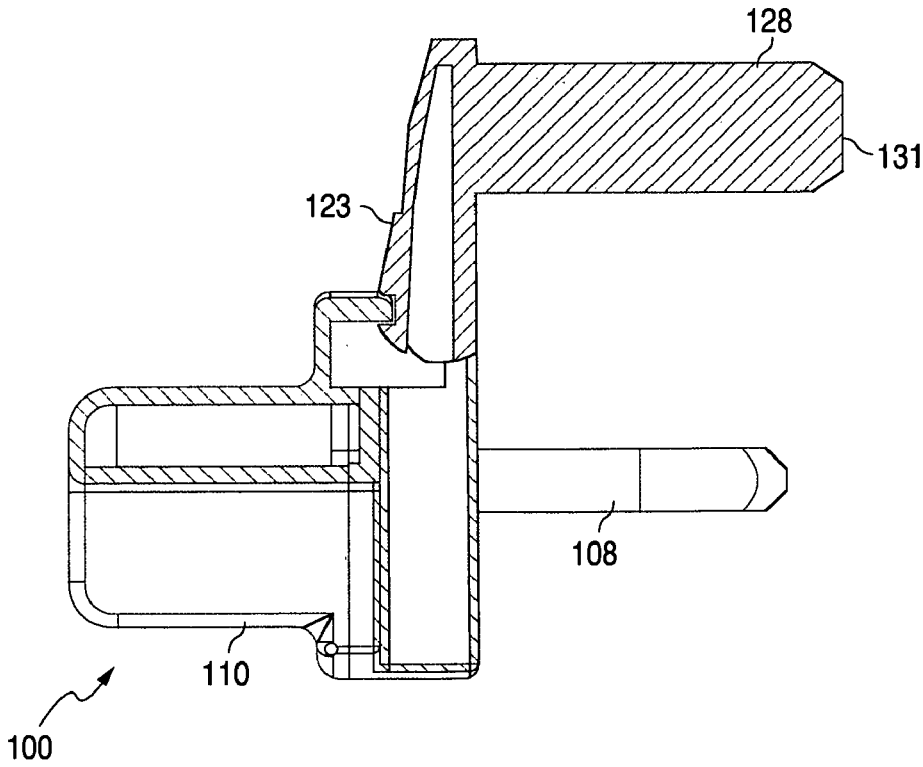
FIG. 6B is a cross-sectional right side view of the electrical plug where the rotatable earth pin is in its interlocked, unfolded position in accordance with the present invention.
Figure 7A:
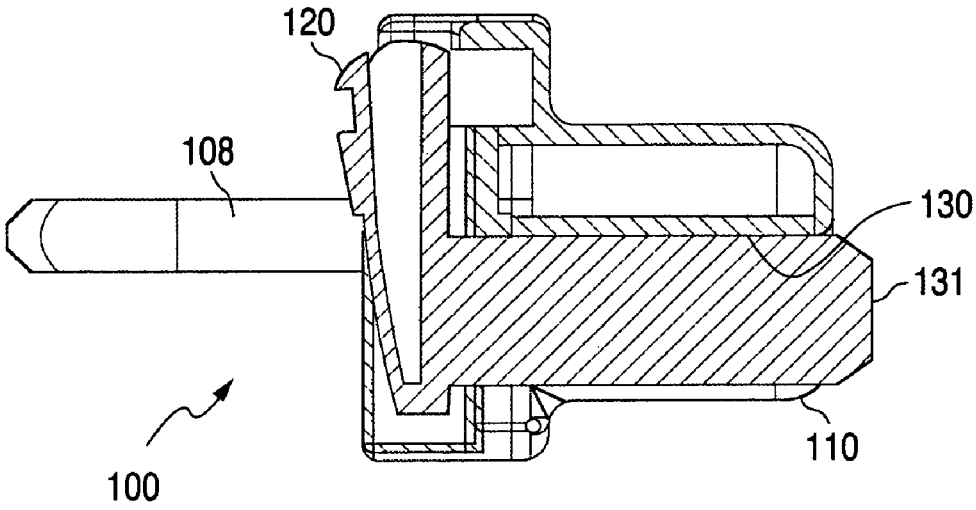
FIG. 7A is a cross-sectional left side view of the electrical plug where the rotatable earth pin is in a folded position in accordance with the present invention.
Figure 7B:
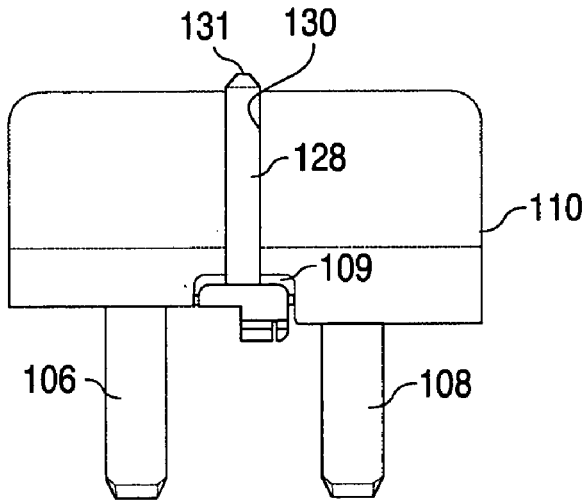
FIG. 7B a bottom view of the electrical plug illustrating the rotatable earth pin in its folded position in accordance with the present invention.
Figure 8A:
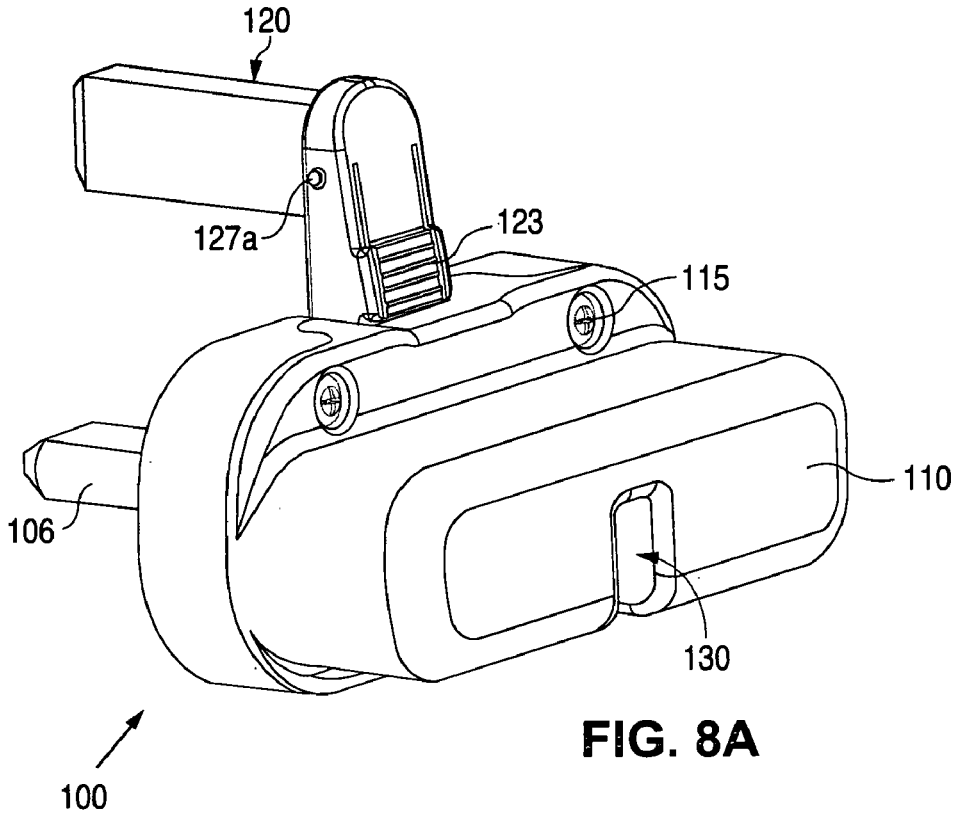
FIG. 8A is a perspective view of the back and left side of the rotatable earth pin plug with the rotatable earth pin in its interlocked, unfolded position in accordance with the present invention.
Figure 8B:
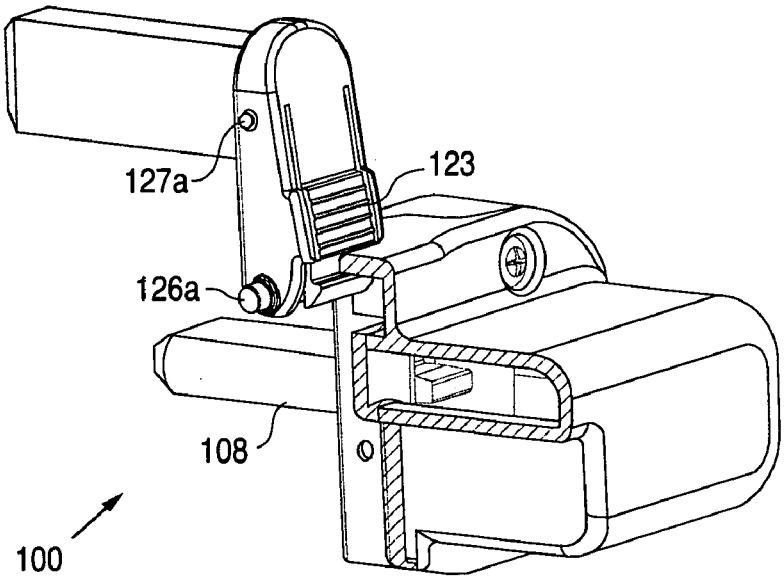
FIG. 8B is a perspective cross-sectional view through the back and left side of the rotatable earth pin plug with the rotatable earth pin in its interlocked, unfolded position and showing the locking mechanism of the rotatable earth pin in accordance with the present invention.
Figure 9A:
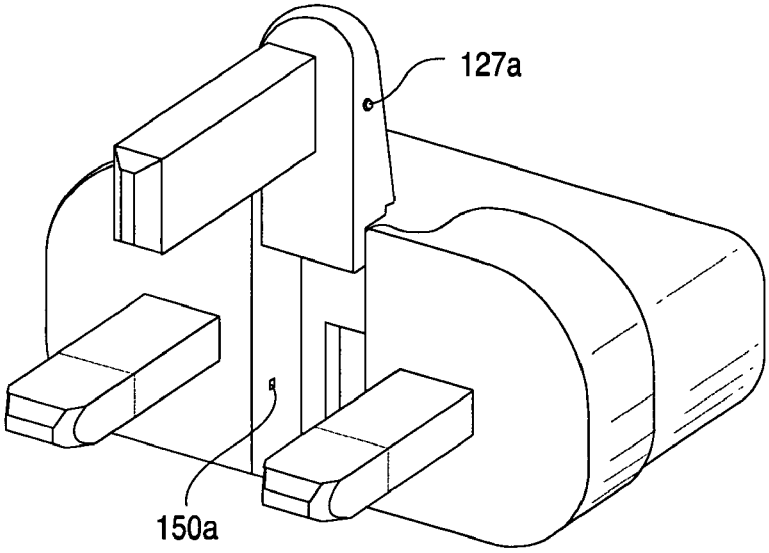
FIG. 9A is a perspective view of the back and left side of the electrical plug where the rotatable earth pin is in its interlocked, unfolded position in accordance with the present invention.
Figure 9B:
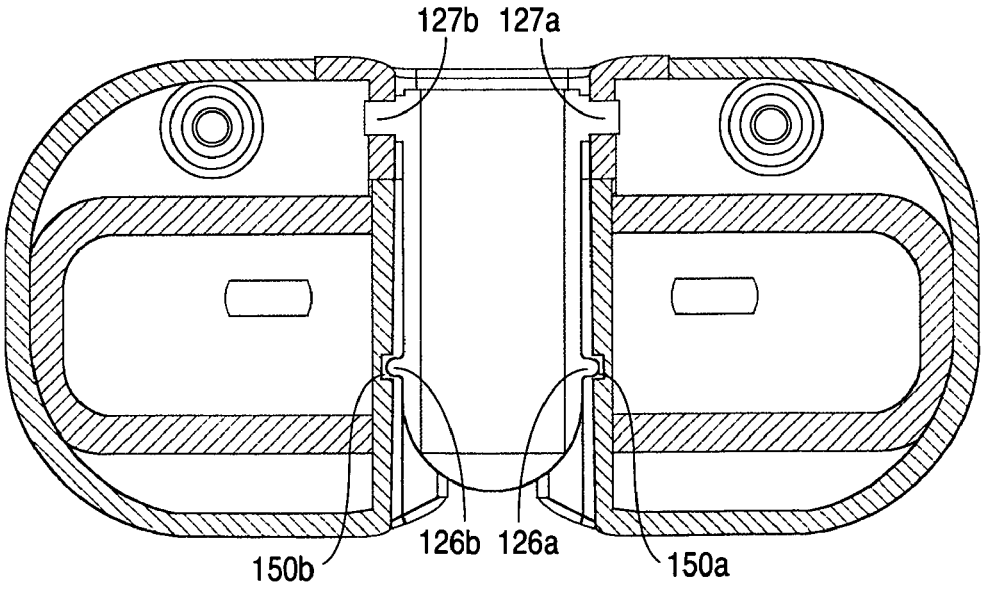
FIG. 9B is an end view of the electrical plug showing the rotatable earth pin in its folded position and showing the pin locking mechanism in accordance with the present invention.

In FIGS. 6A–6B, there are shown a perspective view and a cross-sectional side view, respectively, of the electrical plug 100 in the unfolded position. These figures illustrate how to unlock earth pin 120 from its unfolded position. A pressure is exerted on the locking tab 123 to release the rotatable earth pin 120 from the plug body. When the earth pin 120 is released, it can be manually rotated by 180° to place the electrical plug 100 and its earth pin 120 in a folded position, as shown in FIGS. 7A–7B. Earth pin blade 128 is within passage 130 and protrudes slightly beyond a rear surface of the plug body 120. Therefore, a user can press on the tip 131 of the earth pin blade 128 in order to release the rotatable earth pin 120 from its folded position.

To retain earth pin 120 in its folded position, locking pins 127*a* and 127*b* interlock with grooves 150*a* and 150*b*, respectively, as shown in FIGS. 8A–8B, FIGS. 9A–9B, and FIGS. 4A–4B. When the rotatable earth pin 120 interlocks with plug body 110 by means of the locking pins 127*a* and 127*b* with the grooves 150*a* and 150*b* on the plug body 110, it is thereby releasably maintained in its folded position until manually released by a user.

Figure 10A:
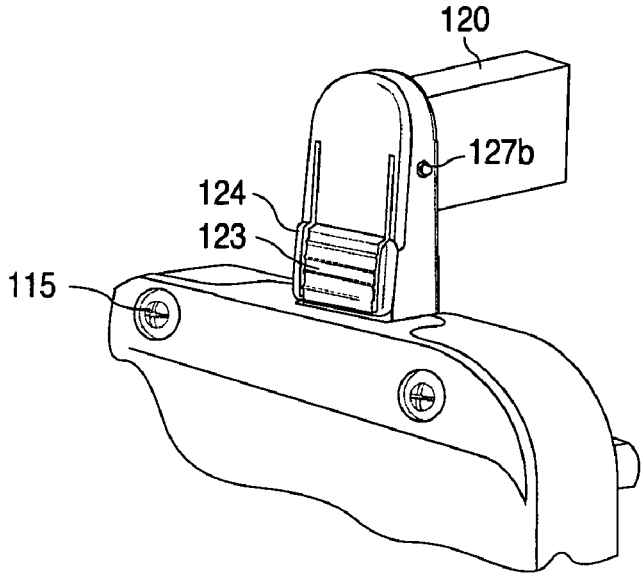
FIGS. 10A–10B are a partial perspective view and a side view, respectively, of the rotatable earth pin plug showing the side locks mechanism in accordance with the present invention.
Figure 10B:
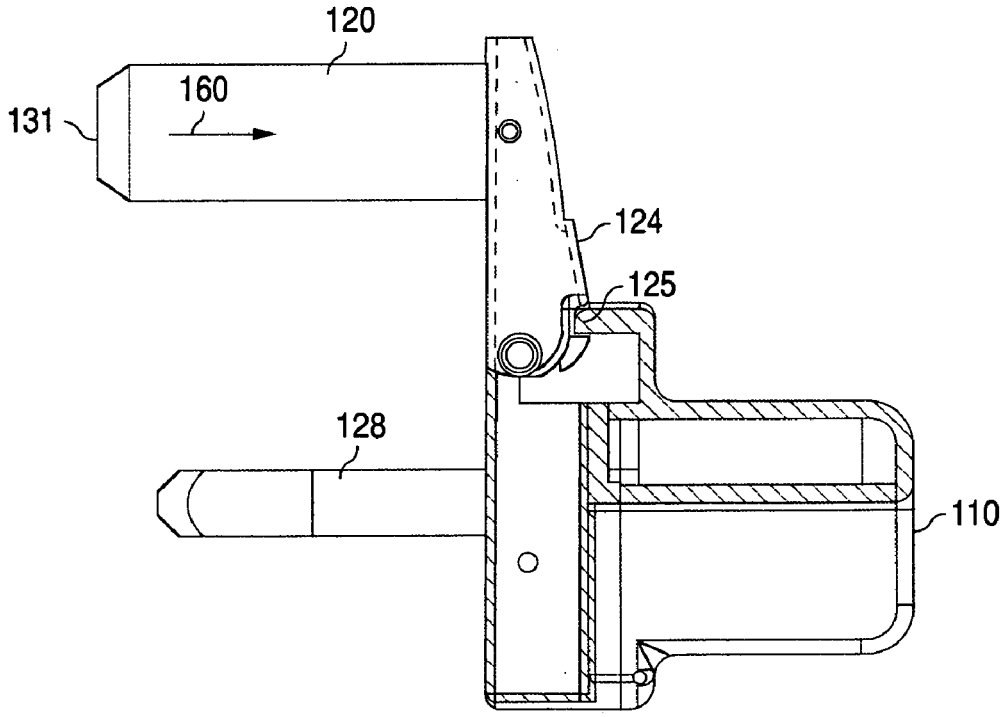

In FIGS. 10A–10B, there are shown perspective views of the electrical plug showing the side locks 124. The side locks 124 in the rotatable earth pin 120 prevent the rotatable earth pin 120 from bending backward during plugging into an electrical source. The direction of the pressure during plugging is shown by arrow 160. The side locks 124 operate like an edge stop, and push against the plug body 110 to prevent the rotatable earth pin 120 from bending backward.

Figure 11A:
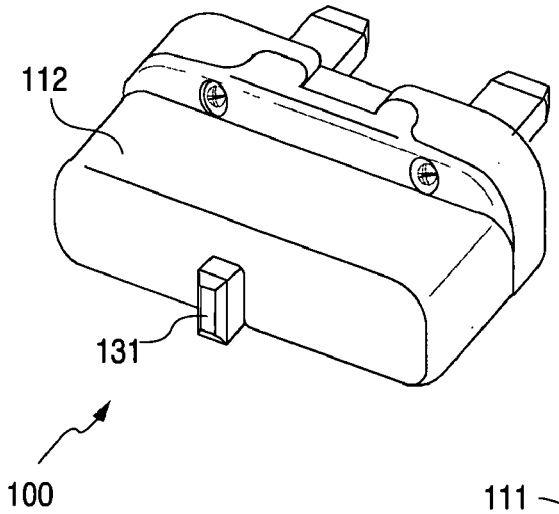
FIGS. 11A–11B are perspective views of the rotatable earth pin in a folded position in accordance with the present invention.
Figure 11B:
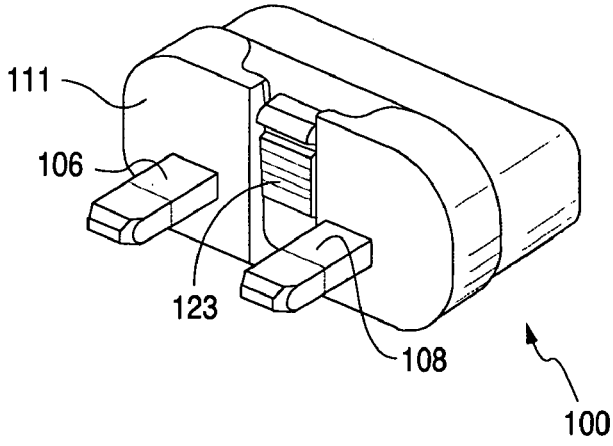
Figure 12A:
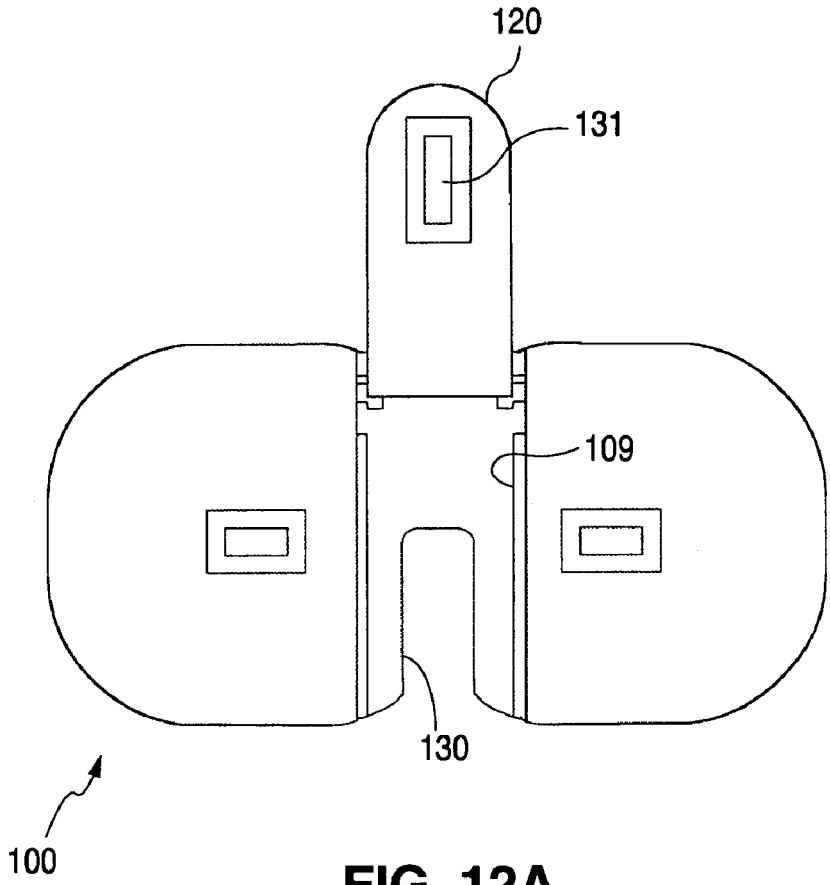
FIGS. 12A–12B are end views of the rotatable earth pin plug showing the earth pin in an unfolded position and in a folded position, respectively, in accordance with the present invention.
Figure 12B:
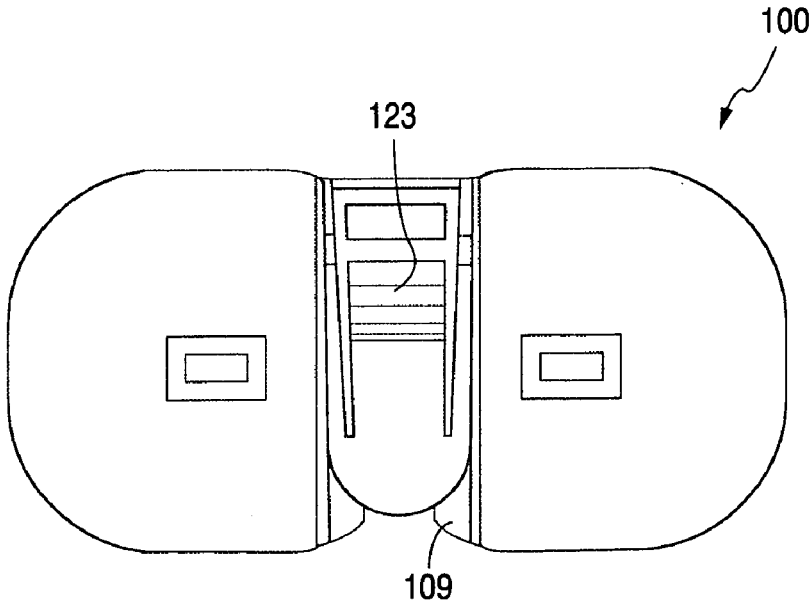

FIGS. 11A–11B are perspective views of the electrical plug in a folded position. An end view of the electrical plug 100 in the unfolded position having the channel 109 and passage 130 for storing rotatable earth plug 120 is shown in FIG. 12A, and an end view of the electrical plug 100 in the folded position is shown in FIG. 12B.

One of ordinary skill in the art should recognize that the present invention can be applied to different types of electrical plugs in various regions or countries. One suitable application is on plugs used in the United Kingdom.

Those skilled in the art can now appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications, whether explicitly provided for by the specification or implied by the specification, will become apparent to the skilled practitioner upon a study of the drawings, specification, and following claims.

I claim:

1. An electrical plug, comprising: a plug body having a first conductive blade and a second conductive blade; and a rotatable earth pin having an arm and an earth pin blade, the arm having a pair of pivot pins on the sides thereof for enabling the rotatable earth pin to rotate between an unfolded position and a folded position, the rotatable earth pin enabled to be releasably locked in said folded position by a pair of locking pins located on the sides of said arm at a position spaced from said pivot pins, and wherein, when the rotatable earth pin is in said folded position, the pair of locking pins interlocks with grooves in said plug body until manually released by the user.

2. The electrical plug of claim 1, further comprising a snap lock formed on the front surface of said arm such that, when the rotatable earth pin is in said unfolded position, said snap lock is latched to said plug body to releasably affix the rotatable earth pin in said unfolded position.

3. The electrical plug of claim 2, wherein said snap lock includes a flexible appendage having a locking press tab and wherein the front surface of said arm has side locks to prevent backward movement of the earth pin when said plug is plugged into an electrical socket.

4. The electrical plug of claim 3, wherein, as pressure is exerted on the locking press tab, the rotatable earth pin is released from its unfolded position on the plug body, to enable the earth pin to be manually rotated to said folded position.

5. The electrical plug of claim 4, wherein the distal end of the rotatable earth pin blade protrudes slightly from the rear surface of the plug body when said rotatable earth pin is in said folded position and, as pressure is exerted on said distal end, the rotatable earth pin is released from said folded position to enable the earth pin to be manually rotated to said unfolded position.

6. The electrical plug of claim 1, wherein the plug body has a front piece and a back piece.

7. The electrical plug of claim 6, wherein the first and second conductive blades extend outwardly from the front piece.

8. The electrical plug of claim 7, wherein fasteners join said front piece to said back piece.

9. An electrical plug, comprising: a plug body having a front piece with a first conductive blade and a second conductive blade extending outwardly therefrom, a back piece, and fasteners joining the front piece to the back piece; and a rotatable earth pin having an arm and an earth pin blade, the arm having a pair of pivot pins on the sides of the rotatable earth pin for rotating the rotatable earth pin approximately 180° from an unfolded position to a folded position, the rotatable earth pin enabled to be releasably locked in said folded position by a pair of locking pins located on the sides of said rotatable earth pin arm, and wherein, when the rotatable earth pin is in said folded position, the pair of locking pins interlocks with grooves in said plug body until manually released by the user.

10. The electrical plug of claim 9, further comprising a snap lock formed on the front surface of said arm such that, when the rotatable earth pin is in said unfolded position, said snap lock is latched to said plug body to releasably affix the rotatable earth pin in said unfolded position.

11. The electrical plug of claim 10, wherein said snap lock includes a flexible appendage having a locking press tab and wherein the front surface of said arm has side locks to prevent backward movement of the earth pin when said plug is plugged into an electrical socket.

12. The electrical plug of claim 11, wherein, as pressure is exerted on the locking press tab, the rotatable earth pin is released from its unfolded position on the plug body to enable the earth pin to be manually rotated to said folded position.

13. The electrical plug of claim 12, wherein the distal end of the rotatable earth pin blade protrudes slightly from the rear surface of the plug body when said rotatable earth pin is in said folded position and, as pressure is exerted on said distal end, the rotatable earth pin is released from said folded position to enable the earth pin to be manually rotated to said unfolded position.

14. An electrical plug, comprising: a plug body having a first conductive blade and a second conductive blade; and a rotatable earth pin having an arm and an earth pin blade, the arm having a pair of pivot pins on the sides thereof for enabling the rotatable earth pin to rotate between an unfolded position and a folded position, the rotatable earth pin enabled to be releasably locked in said folded position by a first lock located on at least one side of said arm at a position spaced from said pivot pins, and enabled to be releasably locked in said unfolded position by a second lock formed on said arm.

15. An electrical plug, comprising: a plug body having a front piece with a first conductive blade and a second conductive blade extending outwardly therefrom, a back piece, and fasteners joining the front piece to the back piece; and a rotatable earth pin having an arm and an earth pin blade, the arm having a pair of pivot pins on the sides of the rotatable earth pin for rotating the rotatable earth pin approximately 180° from an unfolded position to a folded position, the rotatable earth pin enabled to be releasably locked in said folded position by a first lock located on the sides of said rotatable earth pin arm, and enabled to be releasably locked in said unfolded position by a second lock formed on said arm.

* * * * *